US010731792B2

(12) United States Patent
Cann

(10) Patent No.: US 10,731,792 B2
(45) Date of Patent: Aug. 4, 2020

(54) SYSTEM AND METHOD FOR STORAGE OF CRYOGENIC MATERIAL

(71) Applicant: Mark Cann, Cocoa Beach, FL (US)

(72) Inventor: Mark Cann, Cocoa Beach, FL (US)

( * ) Notice: Subject to any disclaimer, the term of this patent is extended or adjusted under 35 U.S.C. 154(b) by 169 days.

(21) Appl. No.: 16/149,058

(22) Filed: Oct. 1, 2018

(65) Prior Publication Data

US 2020/0103076 A1 Apr. 2, 2020

(51) Int. Cl.
*F17C 3/06* (2006.01)

(52) U.S. Cl.
CPC ..... *F17C 3/06* (2013.01); *F17C 2203/0366* (2013.01)

(58) Field of Classification Search
CPC ..... F17C 3/06; F17C 2203/0366; F17C 3/08; F17C 3/085; F17C 13/06; F17C 2205/0149; F25D 31/00
USPC ..... 62/47.1, 51.1, 7, 616, 100; 220/560.1
See application file for complete search history.

(56) References Cited

U.S. PATENT DOCUMENTS 2,834,187 A * 5/1958 Loveday ..... F17C 3/08 62/48.3
3,698,200 A * 10/1972 Johnson ..... F17C 3/08 62/50.2
4,183,221 A * 1/1980 Yamamoto ..... F17C 3/04 62/53.1
4,242,885 A * 1/1981 Quack ..... F25J 1/0067 62/500
4,292,062 A * 9/1981 Dinulescu ..... B60K 15/013 62/240
4,715,186 A * 12/1987 Ishimaru ..... F17C 13/085 220/506
2009/0282840 A1* 11/2009 Chen ..... F25J 1/0242 62/50.3
2017/0268341 A1* 9/2017 Cann ..... F03B 13/08

* cited by examiner

*Primary Examiner* — Justin M Jonaitis

(57) ABSTRACT

The present invention is a system and method of storing various quantities of cryogenic material with lower cost than systems found in prior art. Novel feature of the system is the ability to use minimum amounts of different types of energy to maintain various quantities of cryogenic material. An additional novel feature is the use of common components and materials.

2 Claims, 1 Drawing Sheet

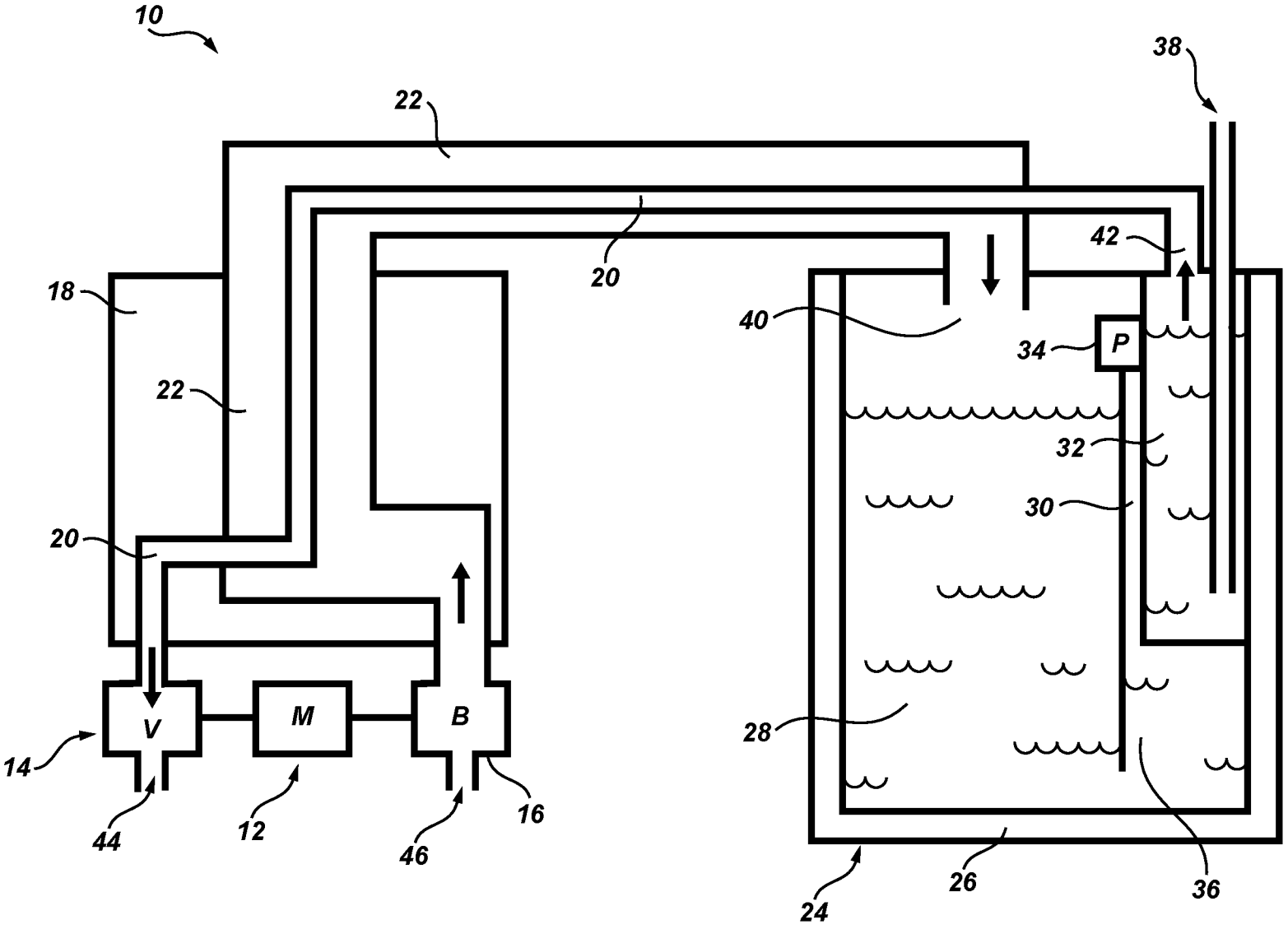
10
38
42
P
34
32
30
36
26
24
40
28
20
22
16
B
46
M
12
22
V
44
18
20
14

SYSTEM AND METHOD FOR STORAGE OF CRYOGENIC MATERIAL

CROSS-REFERENCE TO RELATED APPLICATIONS

This application claims priority from provisional U.S. Application No. 62/566,246 filed Sep. 29, 2017, which is incorporated herein by reference in its entirety.

FIELD OF THE INVENTION

The present invention is in the technical field of material storage. More specifically, the present invention is in the technical field of storing material that is in a cryogenic state.

BACKGROUND OF THE INVENTION

Conventional methods of storing cryogenic material require specialized equipment, where as the present invention is capable of storing large quantities of cryogenic material using low cost components. The storage of cryogenic material is well known and the information in the prior art references is incorporated by reference into this system and method.

U.S. Pat. No. 4,292,062A (Dinulescu, Sanders) details a system for storing cryogenic material with the use of a secondary material. The system described is difficult and expensive to manufacture.

U.S. Pat. No. 3,782,128A (Hampton, Cavanna, Kungys, Eifel) details a system for storing cryogenic material. The system described is difficult and expensive to manufacture.

U.S. Pat. No. 3,814,275A (Lemons) details a system for storing and transporting cryogenic material. The system described was limited to marine related vessels.

SUMMARY OF THE INVENTION

The present invention is a system and method of storing various quantities of cryogenic material with lower cost than systems found in prior art. Novel feature of the system is the ability to use minimum amounts of different types of energy to maintain various quantities of cryogenic material. An additional novel feature is the use of common components and materials.

BRIEF DESCRIPTION OF THE DRAWING

FIG. 1 is a perspective view of the main components of the present invention.

DETAILED DESCRIPTION OF THE INVENTION

Referring to the FIGURES provided by way of exemplification and not limitation, a system having preferred features of the present invention is described. As seen in the FIGURE, components of the present invention may have features of other cryogenic storage systems, but has differences that provide novel and useful features for the cost effective method of storing cryogenic material.

Referring now to the invention in FIG. 1 there is shown a system 10 that contains a primary vessel 24 with an insulating layer 26 to slow the transfer of thermal energy from the surroundings into the primary cryogenic material 28, which can be any substance that is capable of existing in the cryogenic state, such as atmospheric air. Within the primary vessel 24 is a secondary vessel 30 that contains a secondary cryogenic material 32, which can be the same or different that the primary cryogenic material 28 contained in the primary vessel 24. There is a cryogenic inlet port 38 to inject secondary cryogenic material 32 from an external source into the secondary vessel 30. The primary cryogenic material 28 within the primary vessel 24 may be transferred into the secondary vessel 30 by the pump 34 that is connected to the secondary vessel 30 and the pump inlet 36 located within the primary vessel 24. The pressure level inside the secondary vessel 30 is below atmospheric pressure causing the secondary cryogenic material 32 to change into the gaseous state and flow out of the secondary vessel 30 via the exit port 42. The gaseous material 20 flows through a heat exchanger 18 towards a vacuum pump 14, which lowers the pressure inside the secondary vessel 30. A motor 12 powers the vacuum pump 14. The gaseous material 20 leaves via the vacuum exit 44 and can be recycled as part of a closed cycle or released as part of an open cycle. A motor 12 powers the blower 16 that is connected to the heat exchanger 18. A secondary material in the gaseous state 22 enters the blower inlet 46. The gaseous material 20 and secondary gaseous material 22 flow in opposite directions within the heat exchanger 18, transferring the thermal energy from the secondary gaseous material 22 to the gaseous material 20. As the secondary gaseous material 20 flows through the primary vessel entrance 40, the temperature level is similar to the gaseous material 20 as it flows through the exit port 42. As the secondary cryogenic material 32 within the secondary vessel 30 changes into the gaseous state, the secondary vessel 30 absorbs thermal energy from the primary cryogenic material 28 within the primary vessel 24. This prevents the primary cryogenic material 28 from changing into the gaseous state while also allowing the secondary gaseous material 22 to condense within the primary vessel 24, thus providing additional primary cryogenic material 28. The blower 16 and vacuum 14 maintains a difference in pressure between the primary vessel 24 and secondary vessel 30 that maintains the transfer of thermal energy between the primary cryogenic material 28 and the secondary cryogenic material 32. The energy that powers the motor 12 and pump 34 is converted into thermal energy by the change of state in the secondary cryogenic material 32 and secondary gaseous material 22.

In further detail, still referring to the invention of FIG. 1, the dimensions of the vessel 24 and heat exchanger 18 can vary depending on the system 10 requirement and surrounding environment. The ratio of the flow rates of the gaseous material 20 and secondary gaseous material 22 may change depending on the system 10 requirement and surrounding environment. The dimensions of the secondary vessel 30 may vary depending on the system 10 requirements and surrounding environment. The size and capacity of the vacuum pump 14 and blower 16 may vary depending on the system 10 requirements and surrounding environment.

The construction details of the invention as shown in FIG. 1 are that the vessel 24 secondary vessel 30 and heat exchanger 18 may be made of any material sufficiently rigid and strong enough to handle the forces of the gaseous material 20 secondary gaseous material 22 primary cryogenic material 28 and secondary cryogenic material 32.

The system 10 shown in FIG. 1 shows a single stage and multiple stages can be combined to form a system 10.

In broad embodiment, the present invention is a system and method of storing large quantities of cryogenic material with lower cost than systems found in prior art. Novel feature of the system is the ability to use minimum amounts of electricity to maintain large quantities of cryogenic material. An additional novel feature is the use of common components and materials.

Modifications of the structure, arrangement, proportions, elements, materials, and components used in the practice of the present invention, and otherwise, some of which are adapted to specific environments and operative requirements, can be made without departing from the principles of the present invention. Various types of electrical controls may be required, which have not been shown or discussed. Various types of valves may be required, which have not been shown or discussed.

While the foregoing written description of the invention enables one of ordinary skill to make and use what is considered the best mode thereof, those of ordinary skill will understand and appreciate the existence of variations, combinations, and equivalents of the specific embodiment, method, and examples. The invention should therefore not be limited by the above described embodiment, method, and examples, but by all embodiments and methods within the scope and spirit of the invention as claimed.

The present invention may be carried out in other specific ways than those set forth without departing from the essential characteristics of the invention. The present embodiment are, therefore, to be illustrative and not restrictive, and all changes coming within the meaning and equivalency range of the appended claims are embraced.

It should be understood that other materials will be the mechanical equivalent of liquefied atmospheric air in the system described and claimed. It should be understood that other gases will be the mechanical equivalent of atmospheric air in the system described and claimed.

What I claim as my invention is:

1. A cryogenic material storage system comprising:

a. a primary cryogenic material source;

b. a secondary cryogenic material source;

c. a primary vessel (24) with an insulating layer (26) connected to the primary cryogenic material source and a secondary vessel (30) located within the primary vessel (24) connected to the secondary cryogenic material source within the primary vessel (24) with an input port (38);

d. at least one externally powered motor (12) connected to a vacuum pump (14) and a blower (16);

e. wherein the vacuum pump (14) has an exit port (44) and the blower (16) has an input port (46);

f. a heat exchanger (18) that allows gaseous materials to transfer thermal energy;

g. a pump (34) with input port (36) to transfer the primary cryogenic material from the primary vessel (24) into secondary vessel (30);

h. an input port (40);

i. an exit port (42);

j. a connection (20) between the heat exchanger (18) and exit port (42);

k. a connection (22) between the heat exchanger (18) and input port (40).

2. A method of cryogenic material storage, comprising the following steps:

a. selecting a system that includes:

a primary cryogenic material source;

a secondary cryogenic material source;

a primary vessel (24) with an insulating layer (26) connected to the primary cryogenic material source and a secondary vessel (30) located within the primary vessel (24) connected to the secondary cryogenic material source within the primary vessel (24) with an input port (38);

at least one externally powered motor (12) connected to a vacuum pump (14) and a blower (16);

wherein the vacuum pump (14) has an exit port (44) and the blower (16) has an input port (46);

a heat exchanger (18) that allows gaseous materials to transfer thermal energy;

a pump (34) with input port (36) to transfer material from the primary vessel (24) into secondary vessel (30);

an input port (40);

an exit port (42);

a connection (20) between the heat exchanger (18) and exit port (42);

a connection (22) between the heat exchanger (18) and input port (40);

b. the insulating layer (26) slows the transfer of thermal energy from an ambient;

c. the secondary cryogenic material changes into a gaseous state via the vacuum pump (14);

d. the primary cryogenic material transfers thermal energy to the secondary cryogenic material extending the ability to remain in a liquid state;

e. the now gaseous material (20) flows through the heat exchanger (18) transferring any remaining thermal energy to the gaseous material (22) that enters the blower (16) via the input port (46);

f. as the gaseous material enters the input port (40) of the primary vessel (24), the gaseous material joins the existing primary cryogenic material;

g. a pump (34) with an input port (36) transfers the primary cryogenic material into the secondary vessel (30) as needed;

h. an energy to power the blower (16) vacuum (14) and pump (34) has been transferred into thermal energy.

* * * * *